United States Patent [19]

Sukopp

[11] Patent Number: 4,566,611

[45] Date of Patent: Jan. 28, 1986

[54] METERING OR ATOMIZING PUMP WITH A PUMP CASING AND AN OPERATING PUSHER

[75] Inventor: Hans Sukopp, Orsenhausen, Fed. Rep. of Germany

[73] Assignee: Firma Ing. Erich Pfeiffer GmbH & Co., Fed. Rep. of Germany

[21] Appl. No.: 511,105

[22] Filed: Jul. 6, 1983

[30] Foreign Application Priority Data

Jul. 10, 1982 [DE] Fed. Rep. of Germany ..... 3225911

[51] Int. Cl.[4] ..... B65D 83/14

[52] U.S. Cl. ..... 222/153; 222/402.11

[58] Field of Search ..... 222/153, 402.11, 320, 222/321, 340, 341, 182, 402.13

[56] References Cited

U.S. PATENT DOCUMENTS

| | | | |
|---|---|---|---|
| 3,169,672 | 2/1965 | Soffer et al. | 222/153 |
| 3,286,885 | 11/1966 | Huling | 222/182 |
| 3,738,537 | 6/1973 | Gach | 222/153 |
| 4,162,746 | 7/1979 | Anderson et al. | 222/153 |
| 4,171,758 | 10/1979 | Corba | 222/402.13 X |

*Primary Examiner*—Stanley H. Tollberg
*Attorney, Agent, or Firm*—Steele, Gould & Fried

[57] ABSTRACT

A pump for dispensing fluids and like media, having a pump casing including structure forming a counter locking means, a pusher for operating the pump, movable from a rest position into the pump casing to deliver a pumping stroke responsive to manual depression of an operating surface formed in an end face of the pusher, a locking mechanism for the pusher formed by the operating surface and a locking portion rigidly affixed to the operating surface, the locking mechanism being pivotally attached to the pusher to enable movement of the locking portion into and inwardly of a locking position relative to the counter locking means of the pump casing, whereby each pumping stroke must be preceded by pivotal movement of the locking mechanism, and, resilient structure for automatically urging the locking portion outwardly, into the locking position, after each pumping stroke, whereby pressure exerted upon any portion of the end face other than the operating surface will be ineffective for accidentally operating the pump and delivering an unwanted pumping stroke.

8 Claims, 4 Drawing Figures

METERING OR ATOMIZING PUMP WITH A PUMP CASING AND AN OPERATING PUSHER

BACKGROUND OF THE INVENTION

The invention relates to a metering or atomizing pump with a pump casing and an operating pusher, which is operable by the user's finger.

Such pumps are used for dispensing liquid, pasty or gel-like media, which are dispensed in the form of an atomized or continuous jet or a single stream from a dispensing or atomizer opening. The latter is usually part of the operating pusher and is supplied by the hollow piston rod of the pump. As the operating pusher normally forms the upper end of the pump mounted on the container, it is easily possible that during transportation to the user or by the user, e.g. in a vanity case, or on falling over, the pump is unintentionally operated, so that liquid escapes. As usually the upper inoperative position is that in which the pump tightly seals the container, an operation could also lead to a further outflow of the content, independently of a repeated use.

SUMMARY OF THE INVENTION

The object of the invention is to provide a metering or atomizing pump, in which there is only a limited risk of the escape of the medium in a container as a result of unintentional operation.

According to the invention, this object is achieved in that the operating pusher has a locking bolt, which cooperates with the pump casing, which is disengaged from the latter during manual depression and returns automatically to its locked position after operation.

The locking bolt can have a bolt operating face located in the area of the operating face of the operating pusher opposite to the dispensing or atomizer opening. Due to the fact that only part of the total operating face leads to an unlocking of the locking bolt, there is only a limited risk that, in the case of unintentional operation, the lock is released. Further assistance in this connection is provided, if the bolt operating face is preferably recessed with respect to the remainder of the operating face. This ensures that the finger, which is almost automatically inserted in the recessed face, does in fact operate the bolt, whereas mere pressure from above by another object does not cause unlocking.

The bolt operating face can preferably comprise a protrusion which protrudes over the edge of the substantially cylindrical operating pusher. This ensures that on operation with the finger, an adequate pressure is applied to ensure unlocking. If this is desired, said protrusion could also be surrounded by parts of the remaining operating face, which further reduces the risk of accidental operation.

The bolt operating face can be connected by a self-resilient, elastic portion to the remaining operating pusher. This makes it possible to manufacture the operating pusher from a single injection moulded part, whose elastic connecting portion forms a hinge, which always returns the bolt to the initial position again.

The locking bolt is consequently advantageously formed from a part of the inverted cup-shaped operating pusher, which is separated from the remainder of the latter by slots. The slots can slope towards the center of the operating face in such a way that the bolt operating face forms a segment of the operating pusher face. Moreover, the slots can continue in the region of the operating pusher casing.

The operating bolt can be constructed in a random manner, for example as a tongue cut out of the operating pusher casing. In the case of a particularly simple construction, the locking bolt can cooperate with an upwardly pointing end edge of the pump casing, forming a L-shaped lever.

It is also possible for the operating bolt to comprise a protrusion and a recess, thereby protecting the pump against operation, together with the removal of the operating pusher.

BRIEF DESCRIPTION OF THE DRAWINGS

The invention is described in greater detail hereinafter relative to non-limiting embodiments shown in the drawings, wherein.

DETAILED DESCRIPTION OF THE PREFERRED EMBODIMENTS

Figure 1:
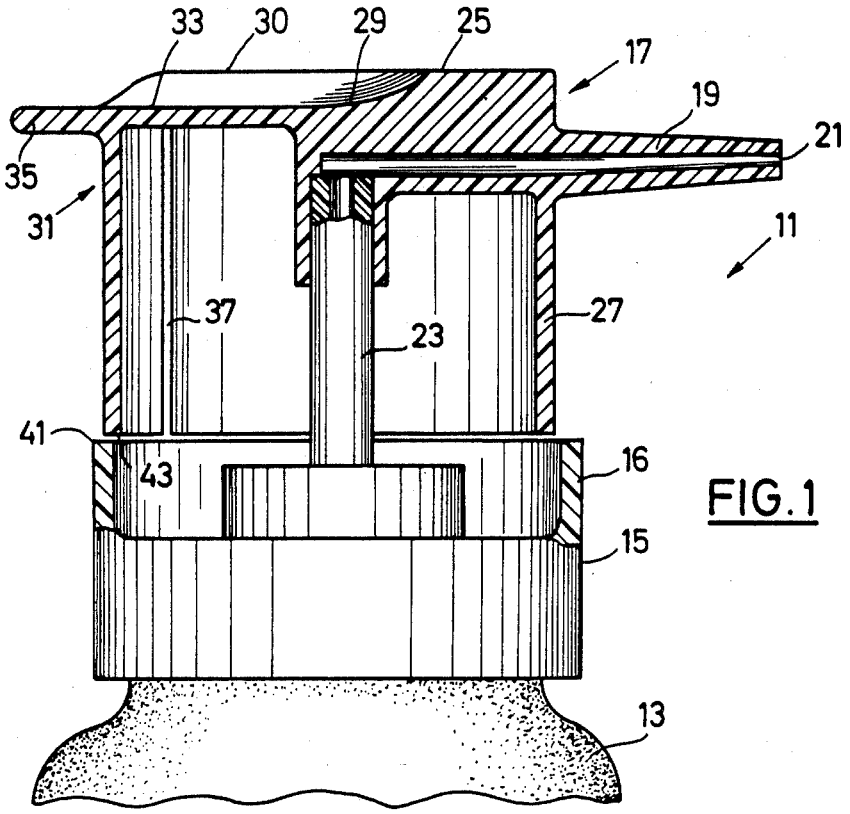
FIG. 1 is a partial cross-section through an operating pusher and a pump casing fitted to a container.
Figure 2:
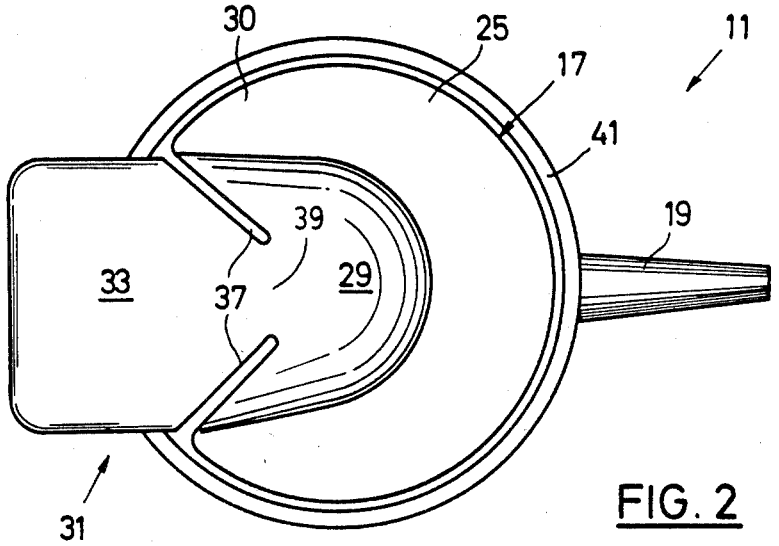
FIG. 2 is a plan view of the construction of FIG. 1.
Figure 3:
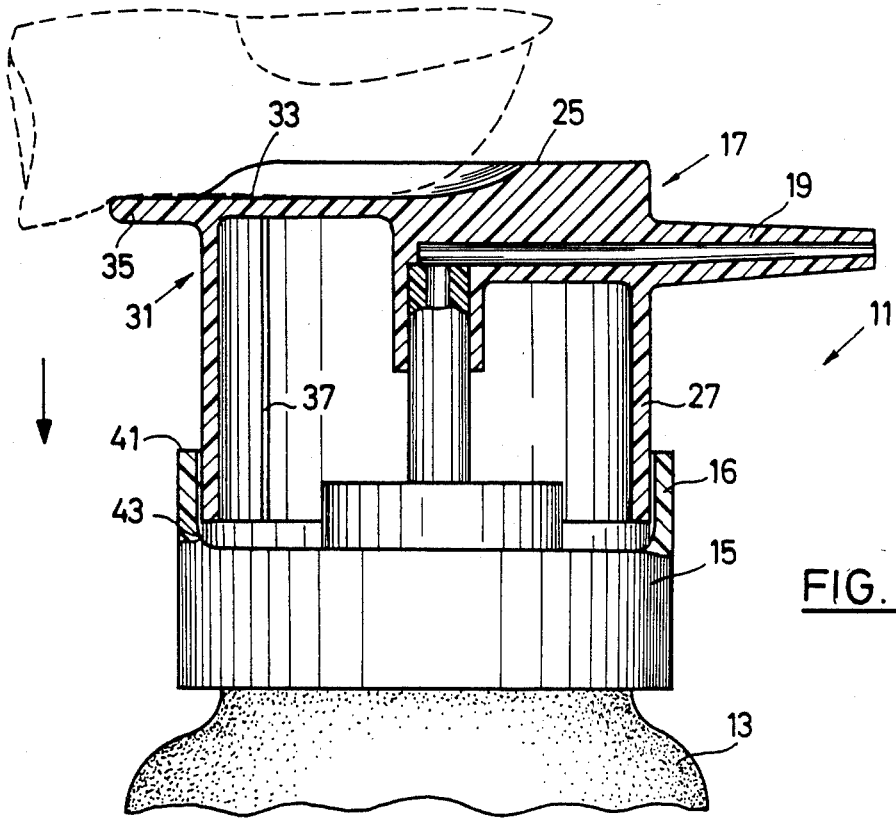
FIG. 3 is a view corresponding to FIG. 1 with the metering or atomizing pump in the operating position.

FIGS. 1 to 3 show an embodiment of a metering or atomizing pump, which is e.g. threadably fitted to a container 13. It has a pump casing 15, in which is fitted a pump cylinder (not shown), which is constructed as a single-acting piston pump and is operated by means of a piston rod 23. An operating pusher 17, having an inverted cup-shaped base form is mounted on the hollow piston rod 23. The base forms the operating face 25 and a substantially circular cylindrical casing 27 extends up to an upright edge 16 of the pump casing.

The hollow piston rod 23 is connected to a delivery pipe 19, which projects radially away from the operating pusher and has a delivery or dispensing opening 21.

The operating face 25 has a recess portion 29, which is shaped like a flat, trough-like recess, which takes up roughly the central area of the operating face and extends up to the edge of said face facing delivery pipe 19. On the same side and extending the recessed portion, is provided a protrusion 35 protruding over the edge of the substantially cylindrical operating pusher. The recessed portion 29 is consequently surrounded by a horseshoe or C-shaped projection 30.

In the operating pusher is provided a locking bolt 31, which is manufactured in one piece with the plastic operating pusher 17. The locking bolt is separated from the aforementioned shape of the operating pusher by means of two slots 37, which run in the axial direction of casing 27, extend up to the lower edge 43 of said casing 27 and also extend into the area of the operating face. On the operating face, they run in a substantially radially sloping direction towards one another and terminate shortly before the central area, so that the portion separated by them remains connected by a connecting portion 39 with the remainder of the operating pusher. The locking bolt forms part of the casing 27, the projection 35 and a part separated in the operating face by slots 37, which forms the bolt operating face 33 and is located in the recessed portion 29.

In the represented embodiment, the operating pusher is constructed somewhat asymmetrically with respect to the pump casing 15 and the piston rod 23 forming the central axis of the pump casing, so that the lower edge 43 is positioned over the end face 41 of the pump casing in the vicinity of the locking bolt, whereas casing 27 of operating pusher 17 otherwise fits within edge 16 of the pump casing.

Thus, in the inoperative state, the operating pusher is prevented from performing a vertical downward movement (operation), because the lower edge 43 of locking bolt 31 rests on end face 41 and prevents operation.

FIG. 3 shows the operating state. The user has pressed the operating pusher downwards with a finger, said finger automatically being applied to the operating pusher from the side facing delivery pipe 19. Thus, pressure acts from above on the bolt operating face and as a result of the lever action caused, which is further reinforced by projection 35, the locking bolt is pivoted somewhat in a counterclockwise direction and specifically about the connecting portion 39, which gives way in an elastic and self-resilient manner, because the operating pusher is made from elastic plastic. This pivoting takes place by such an amount as ensured that the slots 37 in the lower part of the casing are closed. In this position, the lower edge 43 has pivoted so for inwards, that it is freed from the end face 41 of the pump casing and the pump can be operated (FIG. 3).

After releasing the operating pusher 17, the latter is forced upwards again by a return spring in the pump casing and the locking bolt 31 attempts to move back into the position of FIG. 1 under the self-resilience in connection portion 39. As soon as the casing portion of the safety bolt is released by the pump casing edge 16, the locking bolt 31 snaps back into the locked position of FIG. 1.

Figure 4:
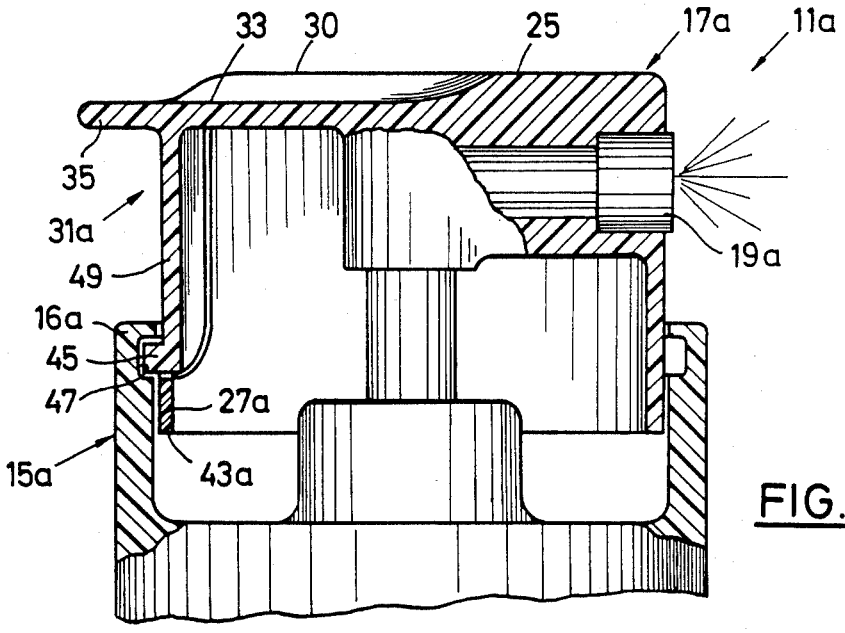
FIG. 4 is a modified embodiment in a section corresponding to FIG. 1.

With the exception of the differences referred hereinafter, the embodiment of FIG. 4 corresponds to that of FIGS. 1 to 3 in all its parts and functions. The same reference numerals are in each case used for the same part and similar or corresponding parts are followed by the letter "a".

In place of delivery pipe 19, operating pusher 17*a* contains an inserted atomizer nozzle. The upper portion of locking bolt 31*a* located in the vicinity of operating face 25 is constructed in the same way as according to FIGS. 1 to 3, but in the casing area is constructed in the form of a cut-out tongue 49, which at its lower end has an outwardly projecting projection 45, located in an annular recess 47 within edge 16*a* of pump casing 15*a*. In this case, also in the inoperative or locked state shown in FIG. 4, the lower edge 43*a* of casing 27*a* projects into edge 16*a* of pump casing 15*a*, so that it is constantly guided therein. On operation and on applying a pressure to the bolt operating face 33, projection 45 is pivoted out of recess 47 and operation is possible. In the represented inoperative position according to FIG. 4, the operating pusher can neither be operated, nor removed, so that complete security is provided against the content running out. In both constructions, the recessing of operating face 33 ensures that an object pressing from above onto the operating pusher is supported on projection 30, so that the locking bolt is not released.

Within the scope of the invention, numerous variants to the represented embodiment are possible. Thus, for example, in place of the asymmetrical construction of the operating pusher according to FIG. 1, it is also possible to provide an outwardly protruding protrusion in the vicinity of edge 43. In FIG. 4, the recess could be provided on the locking bolt and the protrusion on the pump casing while it would also be possible to place the bolt in the interior of the operating pusher, i.e. not to use a pusher casing portion of the locking bolt. However, this would involve a more complicated shape. It is also possible to optionally assist the resilient action of connecting portion 39 by an additional metal or plastic spring, although the represented embodiment is very simple and advantageous. In place of the delivery pipe, the embodiment of FIG. 4 has an atomizer nozzle 19*a* inserted in the operating pusher and which also faces the locking bolt, in order to achieve the desired position of the user's finger.

The arrangement of the bolt operating face 33 facing the dispensing opening has the further advantage that accidental use of the pump with an incorrectly directed opening is prevented, because then the finger would rest e.g. on projection 30 for the remainder of operating face 25, but would not operate the locking bolt. In some other desired alignment of the dispensing opening relative to the user, the arrangement can be correspondingly chosen.

What is claimed is:

1. A pump for dispensing fluids and like media, comprising:

a pump casing including structure forming a counter locking means;

a pusher for operating the pump, movable from a rest position into the pump casing to deliver a pumping stroke responsive to manual depression of an operating surface formed in an end face of the pusher, the operating pusher being formed by an inverted cup-shaped member;

locking means for the pusher formed by the operating surface and a locking portion rigidly affixed to the operating surface, the locking means being pivotally attached to the pusher to enable movement of the locking portion into and inwardly of a locking position relative to the counter locking means of the pump casing, whereby each pumping stroke must be preceded by pivotal movement of the locking means and the locking means being formed by a portion of the cup-shaped member which is separated from the remainder of said pusher by slots; and, resilient means for automatically urging the locking portion outwardly, into the locking position, after each pumping stroke, whereby pressure exerted upon any portion of the end face other than the operating surface will be ineffective for accidentally operating the pump and delivering an unwanted pumping stroke.

2. A pump according to claim 1, wherein the operating surface of the locking means is located diametrically opposite to a dispensing opening for the pump.

3. A pump according to claim 1, wherein the operating surface is recessed with respect to the end face.

4. A pump according to claim 1, wherein the operating pusher is substantially cylindrical and the locking means comprises structure protruding beyond the side edge of the substantially cylindrical operating pusher.

5. A pump according to claim 1, wherein the locking means is pivotally connected to the pusher by a self-resilient, elastic connecting portion.

6. A pump for dispensing fluids and like media, comprising:

a pump casing including structure forming a counter locking means;

a pusher for operating the pump, movable from a rest position into the pump casing to deliver a pumping stroke responsive to manual depression of an operating surface formed in an end face of the pusher;

locking means for the pusher formed by the operating surface and a locking portion rigidly affixed to the operating surface, the locking means being pivotally attached to the pusher to enable movement of the locking portion into and inwardly of a locking position relative to the counter locking means of the pump casing, whereby each pumping stroke must be preceded by pivotal movement of the locking means, the locking means comprising at least one protrusion and one corresponding recess, which prevent both accidental operation of the pump and removal of the operating pusher from the pump casing; and, resilient means for automatically urging the locking portion outwardly, into the locking position, after each pumping stroke, whereby pressure exerted on any portion of the end face other than the operating surface will be ineffective for accidentally operating the pump and delivering an unwanted pumping stroke.

7. A pump according to claim 1, wherein the slots slope towards the center of the end face.

8. A pump according to claim 1, wherein the locking means cooperates with an upwardly directed edge of the pump casing.

* * * * *